US006193443B1

(12) United States Patent
Trudeau et al.

(10) Patent No.: US 6,193,443 B1
(45) Date of Patent: Feb. 27, 2001

(54) ANODE INSTALLATION APPARATUS AND METHOD

(76) Inventors: Adrien R. Trudeau; Ken Stebner; Collen Bootsman, all of c/o 6006 - 42 Avenue, Ponoka, Alberta (CA), T4J 1J8

( * ) Notice: Subject to any disclaimer, the term of this patent is extended or adjusted under 35 U.S.C. 154(b) by 0 days.

(21) Appl. No.: 09/182,189

(22) Filed: Oct. 30, 1998

(51) Int. Cl.[7] ..... E02D 7/00; C23F 13/00

(52) U.S. Cl. ..... 405/252; 204/196; 205/724; 405/303

(58) Field of Search ..... 405/232, 231, 405/252.1, 253, 249, 243, 242; 204/176.17, 196.21, 196.3, 196.36; 205/724

(56) References Cited

U.S. PATENT DOCUMENTS 3,391,072 * 7/1968 Pearson ..... 204/196.21
3,688,014 * 8/1972 Versteeg ..... 405/232
4,504,375 * 3/1985 Griffioen ..... 204/196
4,626,330 * 12/1986 Farmer ..... 204/197
4,688,969 * 8/1987 Bruser et al. ..... 405/303
4,861,449 * 8/1989 St. Onge ..... 204/196.21

* cited by examiner

*Primary Examiner*—Eileen D. Lillis
*Assistant Examiner*—Frederick L. Lagman
(74) *Attorney, Agent, or Firm*—Bennett Jones LLP

(57) ABSTRACT

An anode installation apparatus has an pilot auger to which an anode may be attached, plus a cylindrical drive tube which engages the pilot auger when rotated in one direction, such that the drive tube is drawn downward into the ground along with the pilot auger. When the pilot auger has been augered to a desired depth below ground, carbonaceous material may be introduced into the drive tube so as to surround the anode. The drive tube is then rotated in the opposite direction, whereupon it will disengage from the pilot auger and may be pulled out of the ground, and the cavity thus formed in the ground may be backfilled. The drive shaft may be re-used for installation of additional anodes.

10 Claims, 4 Drawing Sheets

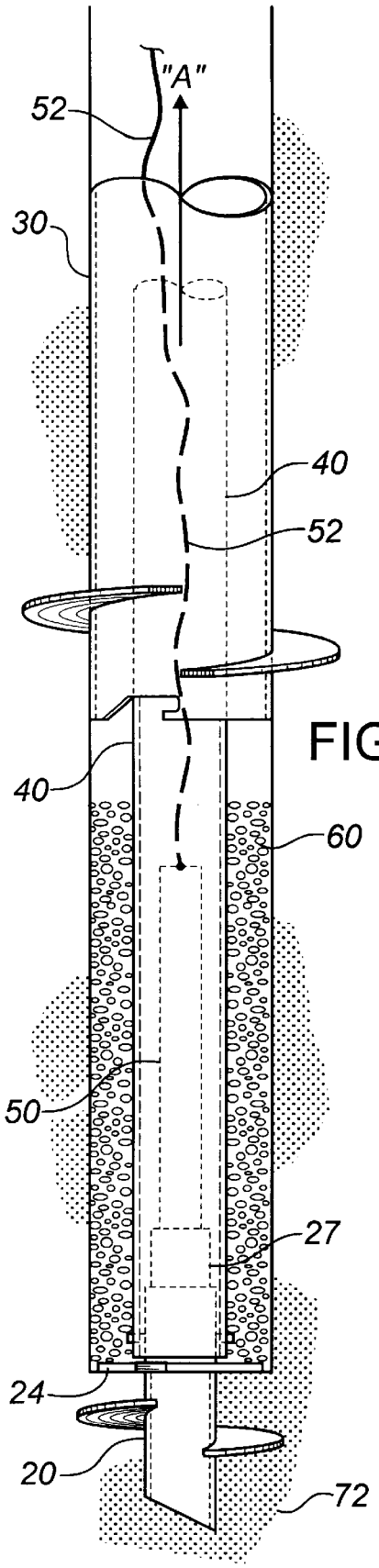
FIG. 6
FIG. 7
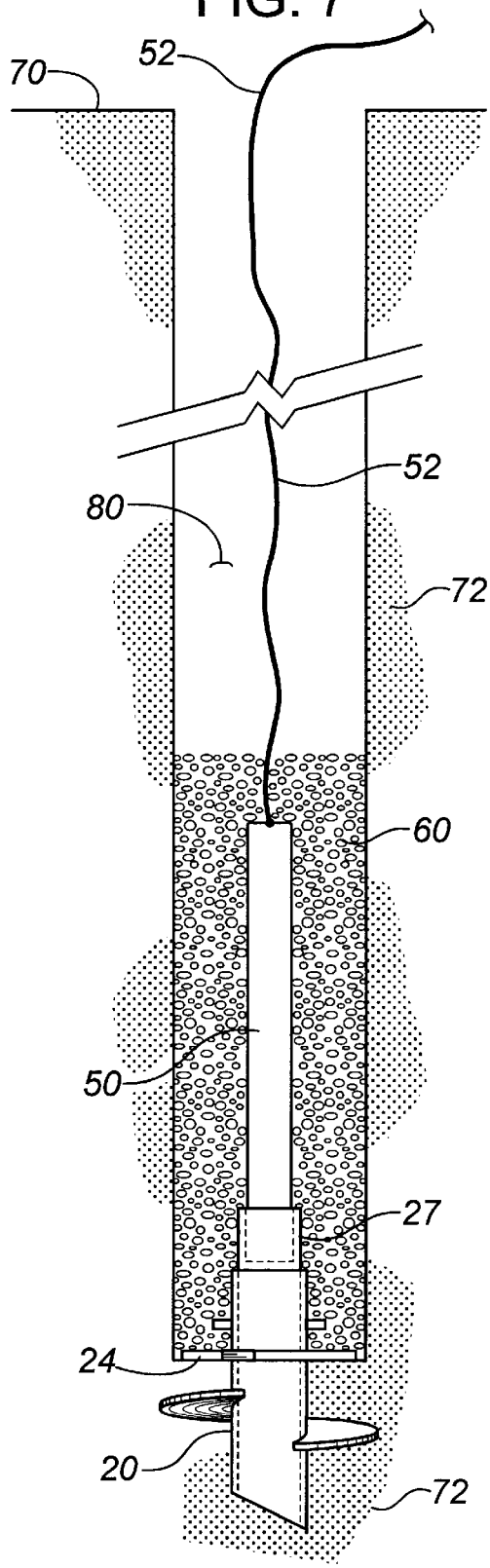

ANODE INSTALLATION APPARATUS AND METHOD

FIELD OF THE INVENTION

The present invention relates to apparatus for underground installation of anodes for cathodic protection systems, and also relates to methods for such installation of anodes.

BACKGROUND OF THE INVENTION

Cathodic protection has long been used to prevent or retard corrosion of oxidizable metallic items placed in contact with the earth, such as pipelines. Cathodic protection systems take advantage of the fact that different metals have different propensities for corrosion, and if items made of different metals are buried while being in electrically-conductive connection with each other, one of the items will corrode before or faster than the other one.

For example, if a steel pipeline is buried underground while being connected by electrical wire to a buried block of magnesium, the magnesium will corrode (i.e., oxidize) before the steel pipeline corrodes. In this example of a cathodic protection circuit, the steel pipeline acts as the cathode, and the magnesium block acts as the sacrificial anode. The pipeline may thus be protected against corrosion so long as it is connected to an appropriate number of anodes, and so long as the anodes are replaced when or before they have been totally consumed by corrosion. To enhance electrical conductivity between the anode and the cathode, and hence the efficacy of the cathodic protection system, the anodes commonly are installed with a buffer layer of carbonaceous filler material, such as charcoal or coke, separating the anodes from the surrounding soil.

There are several known methods of installing anodes. One method involves simply excavating a trench, placing one or more anodes in the trench, connecting the anodes by means of electrical wiring to the buried item desired to be protected against corrosion, and then backfilling the trench with soil. If desired, a layer of coke may be laid in the trench before the anodes are positioned, and then more coke may be added to cover the anodes before the trench is backfilled. Alternatively, the anode used in this method may be of a type which is pre-encased in a canister full of coke.

The trench method described immediately above has obvious disadvantages. It entails the use of trenching equipment such as a backhoe, and it results in an excavation considerably larger than the anode being buried. A correspondingly large amount of backfilling needs to be done after the anode is in place, and it will commonly be necessary to use compacting equipment to consolidate the backfill so as to prevent or minimize subsequent settlement of the backfill. These factors contribute to the time and expense involved in using the trench method.

Another known method involves augering a hole into the ground, lowering an anode into the hole, pouring coke or charcoal into the hole so as to surround the anode, and then backfilling the hole with soil from the top of the charcoal to the ground surface. This method has the advantage of causing considerably less disruption to the soil than the trench method, in that much less soil needs to be excavated and backfilled. As well, consolidation of the backfill often will not be necessary using this method. Accordingly, this method will often allow anodes to be installed more quickly and at less cost that using the trench method.

The augered hole method, as described above, has a significant drawback in that it can be difficult or impossible to use in sloughing or non-cohesive soils. In such cases soil from the sides of the augered hole may fall into the hole before the anode and charcoal can be placed in the hole, and some other method must then be used to install the anode. A further disadvantage of the augered hole system, regardless of the type of soil encountered, is that it can be difficult to keep the anode centered in the hole while the charcoal or coke is being poured in; i.e., the anode may become displaced such that the charcoal or coke does not surround the anode in a uniform thickness, or in some locations does not surround the anode at all.

The problem of sloughing or non-cohesive soils is addressed by a third known method of anode installation, namely the cased hole method. This is essentially the same as the augered hole method with the additional step of installing a cylindrical liner in the hole immediately after the hole has been augered out. The liner prevents sloughing of soil into the hole, so that installation of the anode and charcoal may proceed without complications. The obvious disadvantage of the cased hole method, however, is that the liner must be left permanently in the hole and cannot be re-used, thereby adding to the cost of each anode installation. A further disadvantage is that, as for the uncased augered hole method, it may be difficult to keep the anode centered in the hole to ensure that the anode is surrounded uniformly by charcoal or coke.

The prior art discloses several attempts to provide means for quicker and more efficient installation of anodes. U.S. Pat. No. 4,504,375, issued to Griffioen on Mar. 12, 1985, teaches a cylindrical casing containing an anode surrounded by carbonaceous material, with an electrical connection cable running from the anode to the outside of the casing. The lower end of the casing is formed with a sharp point so that the device may be driven into the ground using appropriate impactor equipment. The Griffioen invention eliminates the need for excavation and backfill during anode installation, and the nature of its assembly ensures uniform charcoal encasement of the anode. However, it has a significant drawback in that it must be left in the ground and has no re-usable components. Another disadvantage of this device is that its use entails some risk of damage to the anode due to shock loading as the device is being driven into the ground.

U.S. Pat. No. 4,626,330, issued to Farmer on Dec. 2, 1986, discloses an anode formed around an auger shaft so that it can be installed by rotating the auger shaft using appropriate rotating equipment. This device requires no excavation or backill, and avoids the risk of shock damage to the anode associated with driven anodes such as Griffioen. However, it has a significant disadvantage in that it does not permit installation of an anode in conjunction with a bedding of carbonaceous material. It has the further drawback of requiring an auger shaft which must be left in the ground and cannot be re-used.

For the foregoing reasons, there is a need for an apparatus and method which may be used to install cathodic protection anodes with carbonaceous bedding more economically and more efficiently than known apparatus and methods, in non-cohesive as well as cohesive soils, with minimal disruption to the soil and correspondingly minimal requirements for backfilling, and without risk of shock damage to the anode during installation. There is a further need for an anode installation apparatus and method entailing minimal need for components of such apparatus to be left permanently buried in the ground.

SUMMARY OF THE INVENTION

In one aspect, the present invention is an apparatus for underground installation of an anode for a cathodic protection system, said apparatus comprising:

(a) a pilot auger having an upper end, a lower end, and an outer perimeter surface, and having one or more helical vanes fixedly attached to said outer perimeter surface;

(b) a drive tube having an open upper end, an open lower end, and an outer perimeter surface; and (c) anode connection means, for connecting an anode to the upper end of the pilot auger;

wherein said upper end of the pilot auger and said lower end of the drive tube are adapted to be releasably engageable with each other. The anode connection means typically will be a short pipe sleeve fastened to the upper end of the pilot auger and having a closed lower end, such that an anode may be inserted into and supported by the sleeve.

In the preferred embodiment of the invention, the pilot auger is fashioned from a section of metal pipe, although it may also be made solid stock without affecting the concept or operation of the invention. Also in the preferred embodiment, the lower end of the pilot auger will be bevelled to form a pointed end which facilitates penetration of the pilot auger into the ground.

The anode connection means may take a variety of forms, depending on the shape of anode which is desired to be installed. Many anodes commonly used for cathodic protection systems are circular in cross-section. For use with such anodes, the anode connection means of the present invention may be a cylindrical sleeve having an inner diameter slightly larger than the anode diameter, and having a closed lower end. The sleeve may be connected to the upper end of the pilot auger, such as by welding.

For purposes of permitting removable engagement of the pilot auger with the drive tube, the pilot auger in the preferred embodiment is provided with a generally circular flange having two flange lugs which are co-planar with the flange and which project radially beyond the basic circular perimeter of the flange. The flange is rigidly connected to the perimeter of the pilot auger, such that the pilot auger is substantially co-axial with the flange, and such that the plane of the flange is substantially perpendicular to the axis of the pilot auger. The drive tube in the preferred embodiment has one or more flange lug notches adapted to engage the drive tube lugs such that:

(a) the axes of the drive tube and the pilot auger will coincide;

(b) rotation of the drive tube in a first direction about its axis will cause corresponding rotation of the pilot auger; and (c) rotation of the drive tube in a second and opposite direction about its axis will cause the flange lug notches of the drive tube to become disengaged from the flange lugs, and will not cause rotation of the pilot auger.

In the preferred embodiment, the drive tube will have one or more helical vanes securely connected around its perimeter. The helical vane or vanes of the drive tube will have the same directional orientation as the helical vane or vanes of the pilot auger, such that all of the helical vanes will act as auger vanes to facilitate augering of the pilot auger/drive tube assembly into the ground when the drive tube is rotated in a first (and typically clockwise) direction.

In the preferred embodiment, the invention also comprises an anode support tube, which is removably engagable with both the pilot auger and the drive tube. The support tube will be of such dimensions that it will fit inside the drive tube, and such that the anode being installed will fit easily but with minimal clearance inside the support tube. With the support tube engaged with the pilot auger, the upper end of the support tube may be temporarily fastened to the drive tube, such as by bolting, so that the support tube will rotate when the drive tube is rotated. In the preferred embodiment, removable engagement of the support tube with the pilot auger is facilitated by providing a two or more support tube lugs projecting from the sides of the pilot auger, and fitting into corresponding slots in the lower end of the support tube.

The support tube provides lateral stability to the anode during the installation of same using the present invention. The support tube may also serve the further function of stabilizing the anode during extraction of the apparatus from out of the ground in cases where, for instance, the pilot auger has encountered a large rock or other obstacle and it has become necessary or desirable to remove the apparatus and to try installing the anode in an alternative location.

In another aspect, the invention is a method for underground installation of an anode for a cathodic protection system, comprising the steps of:

(a) attaching an anode to a pilot auger;

(b) engaging a drive tube with the pilot auger such that:

(i) the drive tube and the pilot auger will rotate co-axially when rotation is imparted to the drive tube in a first direction; and (ii) the drive tube will become disengaged from the pilot auger when rotation is imparted to the drive tube in a second and opposite direction;

(c) positioning the lower end of the pilot auger over the ground surface at a desired location;

(d) rotating the drive tube in said first direction, causing the pilot auger and drive tube to penetrate to a desired depth below ground surface;

(e) rotating the drive tube in said second direction, causing the drive tube to become disengaged from the pilot auger and to be withdrawn completely from the ground, leaving the pilot auger and anode in place underground; and (f) backfilling the cavity formed iii the ground by the withdrawal of the drive tube with a selected material.

In the preferred embodiment, the method of the present invention comprises the additional step of introducing a desired quantity of carbonaceous material into the drive tube, such that the carbonaceous material surrounds the anode, plus the step of removably connecting an anode support tube to the pilot auger to support the anode against displacement during installation.

BRIEF DESCRIPTION OF THE DRAWINGS

Embodiments of the invention will now be described with reference to the accompanying drawings, in which numerical references denote like parts referred to herein, and in which:

FIGS. 5, 6, and 7 are elevational views illustrating a method of use of the preferred embodiment of the apparatus of the present invention.

DETAILED DESCRIPTION OF THE PREFERRED EMBODIMENT

Figure 1A:
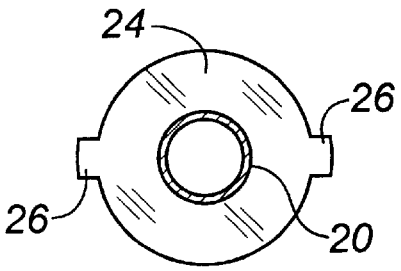
FIG. 1A is a plan view cross-section through the pilot auger, illustrating the flange and flange lugs of the preferred embodiment.
Figure 1:
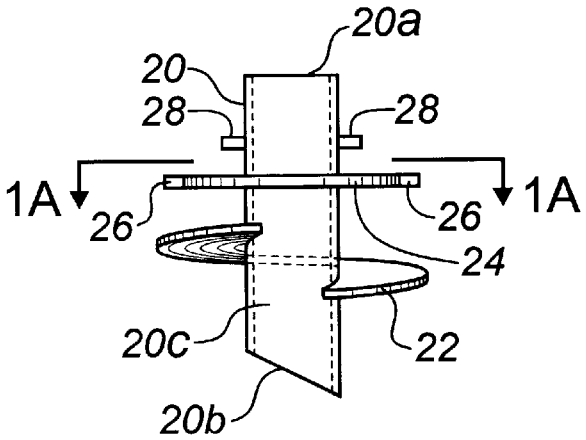
FIG. 1 is an elevational view of the pilot auger of the preferred embodiment of the invention.
Figure 2:
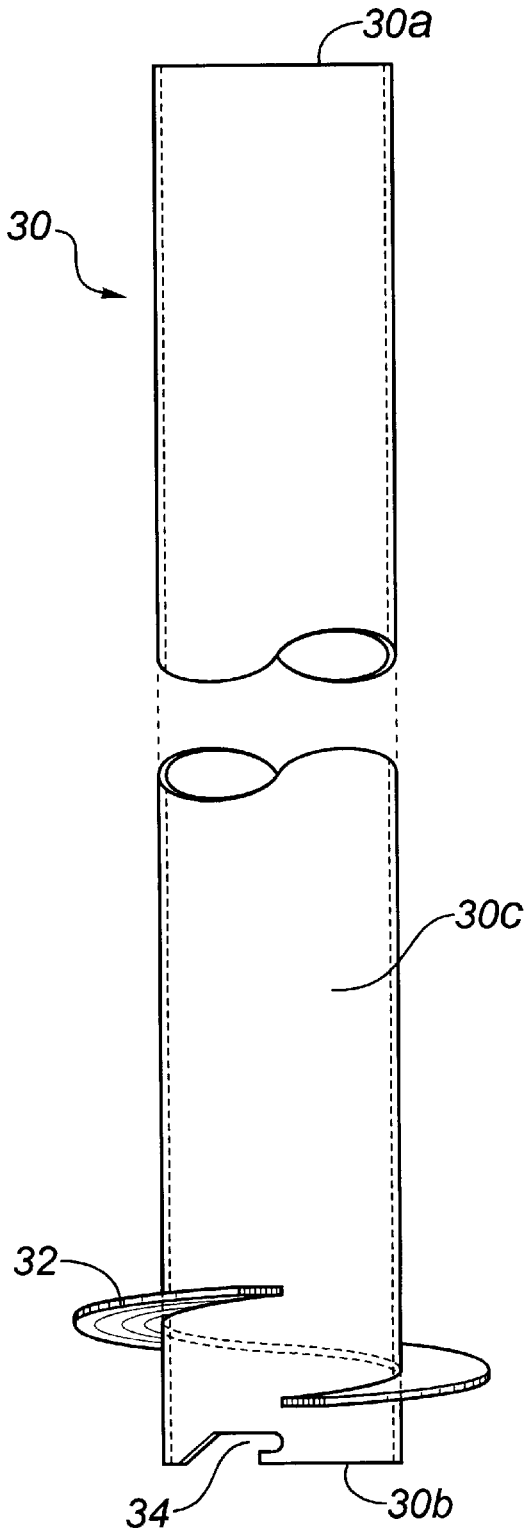
FIG. 2 is an elevational view of the drive tube of the preferred embodiment.

As illustrated in FIGS. 1, 1A, and 2, the apparatus of the present invention comprises a pilot auger (20) having an upper end (20*a*), a lower end (20*b*), and an outer perimeter surface (20*c*), plus a drive tube (30) having an upper end (30*a*), a lower end (30*b*), and an outer perimeter surface (30*c*). The pilot auger (20) has a helical vane (22) firmly attached to the perimeter surface (20*c*) of the pilot auger, and in the preferred embodiment the lower end (20*b*) of the pilot auger (20) will be bevelled as shown in FIG. 1, both of these features being for the purpose of facilitating augering into the ground. Also in the preferred embodiment, the drive tube (30) will have a helical vane (32) rigidly connected to the outer perimeter surface (30*c*) of the drive tube, said helical vane (32) being configured so as to act co-operatively with the helical vane (22) of the pilot auger (20).

The pilot auger (20) of the preferred embodiment will also have two or more support tube lugs (28), the function of which will be explained in greater detail hereinafter.

Figure 3A:
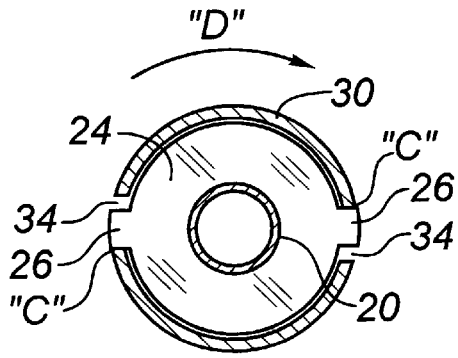
FIG. 3A is a plan view cross-section through the pilot auger and drive tube engaged with each other in accordance with the preferred embodiment.
Figure 3:
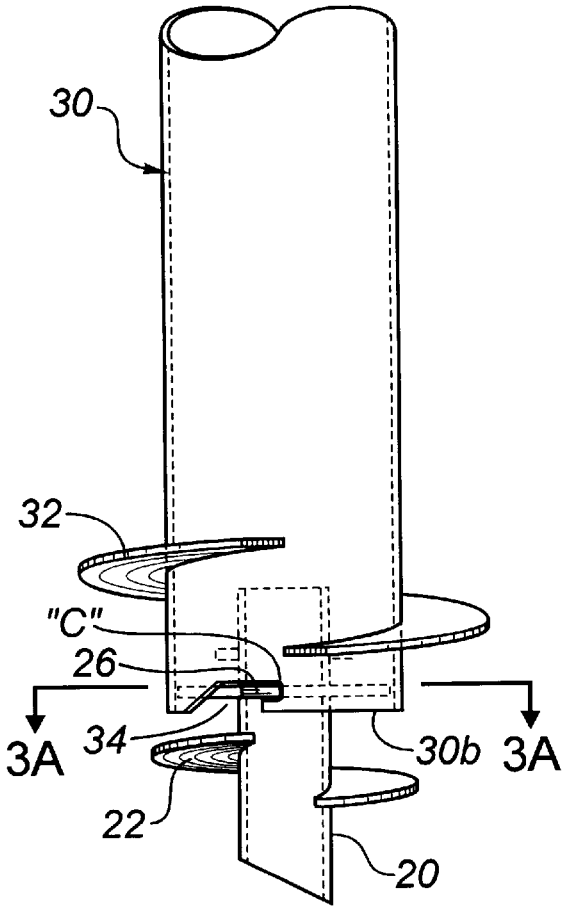
FIG. 3 is a partial elevational view of the pilot auger and the drive tube engaged with each other in accordance with the preferred embodiment.

As illustrated in FIGS. 1 and 1A, the pilot auger (20) of the preferred embodiment also has a planar circular flange (24) fixedly mounted to the outer perimeter surface (20*c*), and the flange (24) has two or more equally spaced flange lugs (26) which project radially beyond the basic circular outline of the flange (24). As illustrated in FIG. 2, the lower end (30*b*) of the drive tube (30) has flange lug notches (34) corresponding with the flange lugs (26) as to number and relative spacing. When the drive tube (30) is positioned over the pilot auger (20) as illustrated in FIGS. 3 and 3A, the flange lugs (26) will be engaged within the flange lug notches (34) such that when the drive tube (30) is rotated in direction "D", the drive tube (30) will make contact with the flange lugs (26) at contact points "C", and will cause the flange (24) and pilot auger (20) to rotate co-axially with the drive tube (30).

Figure 4:
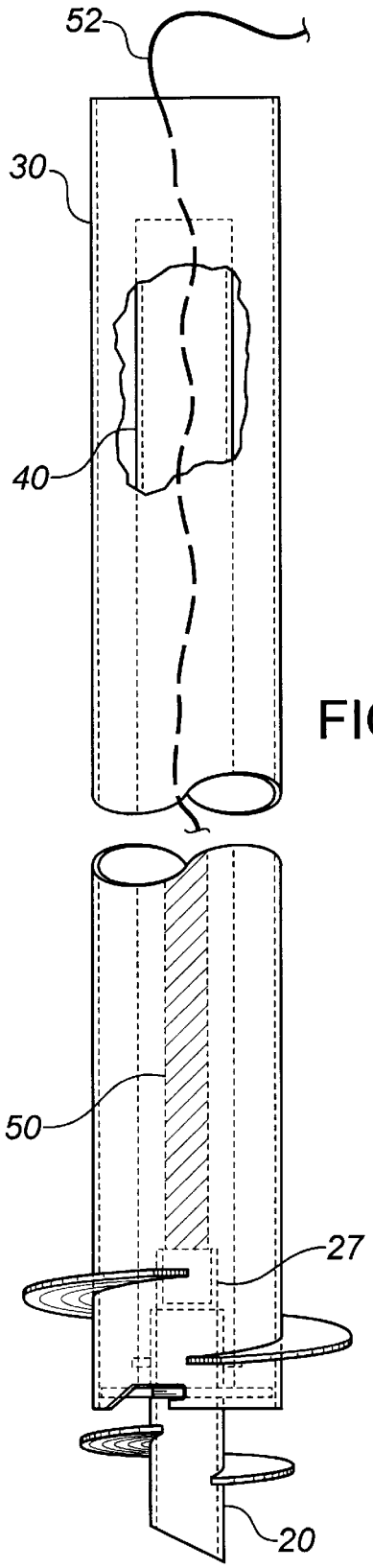
FIG. 4 is an elevational view of the pilot auger, anode support tube, and drive tube of the preferred embodiment, assembled for use in accordance with the invention.

The present invention also provides means for attaching an anode to the pilot auger (20). In FIG. 4, which also shows the drive tube (30) in engagement with the flange (24) and flange lugs (26) of the pilot auger (20) as described above, the anode connection means is illustrated as a cylindrical sleeve (27) attached to the upper end (20*a*) of the pilot auger (20), for use with an anode (50) having a circular cross-section. The sleeve (27) has an inner diameter only slightly larger than the diameter of the anode (50), such that the walls of the sleeve (27) will maintain the anode (50) in substantially vertical orientation. The lower end of the sleeve (27) is partially or totally closed off so as to provide a support surface for the lower end of the anode (50).

Figure 5:
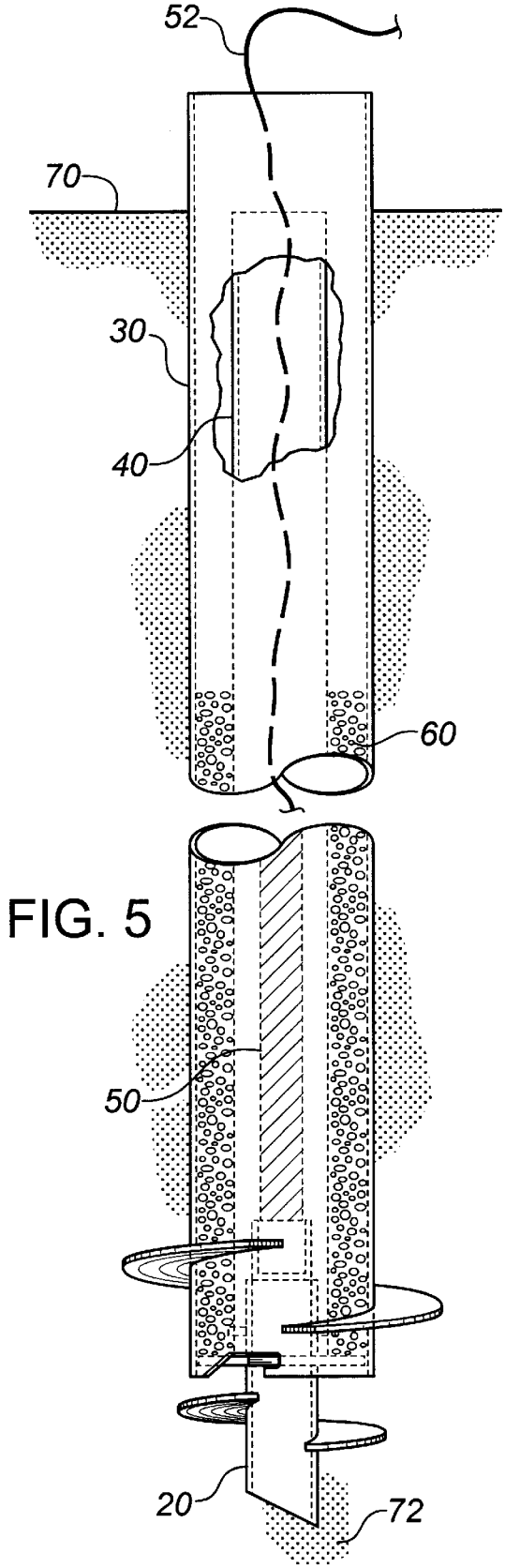

To enhance the lateral stability of the anode (50) during installation, and as shown schematically in FIGS. 4 and 5, the preferred embodiment also comprises an anode support tube (40), having an upper end (40*a*) and a lower end (40*b*). Lower end (40*b*) defines two or more slots (not shown) which may be removably engaged with the support tube lugs (28) referred to previously, such that the support tube (40) will rotate along with the pilot auger (20) when the drive tube (30) is rotated. The upper end (40*a*) of the support tube (40) be connected temporarily to the drive tube (30) using connection means such as bolts (not shown), so that the support tube (40) will be oriented co-axially with the drive tube (30) and will provide lateral support to the anode (50).

FIGS. 5, 6, and 7 illustrate a method of installing an anode according to the preferred embodiment of the present invention. FIG. 5 illustrates the apparatus of the preferred embodiment after having been augered to a selected depth below the ground surface (70) using a suitable rotary power source (not shown), with the anode (50) vertically supported by the sleeve (27) and laterally supported by the support tube (40), and with anode conductor wire (52) extending upward from the anode (50) and out of the support tube (40) and the drive tube (30). Carbonaceous material (60) such as coke or charcoal has been introduced into the annular space between the drive tube (30) and the support tube (40), for purposes of enhancing electrical conductivity to the anode (50).

FIG. 6 shows the drive tube (30) after having been disengaged from the support tube (40) and from the flange (24) of the pilot auger (20), and after having been partially withdrawn out of the ground in direction "A", with the support tube (40) still in place surrounding the anode (50). Upon extraction of the drive tube (30), the carbonaceous material (60) has slumped into the space between the support tube (40) and soil (72). After the drive tube (30) has been fully withdrawn from the ground, the support tube (40) may be disengaged from the support tube lugs (28) and then withdrawn from the ground. As the support tube (40) is being withdrawn, the carbonaceous material (60) will slump into the space which had been occupied by the support tube, thereby substantially surrounding the anode (50) as illustrated in FIG. 7.

Upon complete removal of the drive tube (30) and the support tube (40) as shown in FIG. 7, a cavity (80) remains above the carbonaceous material (60), and the anode conductor wire (52) extends out of the cavity (80), to be connected to cathode (not shown) of a cathodic protection system. The cavity (80) may then be filled with a selected backfill material. The pilot auger (20) along with its associated flange (24) and sleeve (27) remain in the ground permanently, while the drive tube (30) and support tube (40) may be re-used for installation of other anodes.

Numerous variations and modifications of the disclosed preferred and alternative embodiments will be apparent to skilled technicians, without departing from the concept of the present invention, and all such variations and modifications are intended to be encompassed by the claims set forth herein.

The embodiments of the invention in which an exclusive property or privilege is claimed are defined as follows:

1. An apparatus for underground installation of an anode for a cathodic protection system, said apparatus comprising:

(a) a pilot auger having an tipper end, a lower end, and an outer perimeter surface, and having one or more helical vanes fixedly attached to said outer perimeter surface;

(b) a drive tube having an open upper end, an open lower end, an outer perimeter surface, and one or more helical vanes fixedly attached around the perimeter of the drive tube; and (c) anode connection means, for connecting an anode to the upper end of the pilot auger;

wherein said upper end of the pilot auger and said lower end of the drive tube are adapted to be releaseably engageable with each other.

2. The apparatus of claim 1 further comprising a generally circular flange fixedly mounted around the pilot auger above the helical vanes of the pilot auger, the plane of said flange being at substantially at right angles to the longitudinal axis of the pilot auger, wherein said flange further comprises one or more flange lugs, and wherein the lower end of the drive tube defines one or more flange lug notches adapted to engage said flange lugs such that:

(a) the axes of the drive tube and the pilot auger coincide;

(b) rotation of the drive tube in a first direction about its axis will cause corresponding rotation of the pilot auger; and (c) rotation of the drive tube in a second and opposite direction about its axis will cause the flange lug notches to become disengaged from the flange lugs.

3. The apparatus of claim 2, further comprising:

(a) an anode support tube having an open upper end and an open lower end;

(b) means for removably engaging the support tube co-axially with the pilot auger; and (c) means for removably connecting the support tube to the drive tube such that rotation of the drive tube will cause corresponding and substantially co-axial rotation of the support tube.

4. The apparatus of claim 3, wherein the drive tube further comprises means for being connected to a rotating power source.

5. A method for underground installation of an anode for a cathodic protection system, comprising the steps of:

(a) attaching an anode to a pilot auger;

(b) engaging a drive tube with the pilot auger such that:

(i) the drive tube and the pilot auger will rotate co-axially when rotation is imparted to the drive tube in a first direction; and (ii) the drive tube will become disengaged from the pilot auger when rotation is imparted to the drive tube in a second and opposite direction;

(c) positioning the lower end of the pilot auger over the ground surface at a desired location;

(d) rotating the drive tube in said first direction, causing the pilot auger and drive tube to penetrate to a desired depth below ground surface;

(e) rotating the drive tube in said second direction, causing the drive tube to become disengaged from the pilot auger and to be withdrawn completely from the ground, leaving the pilot auger and anode in place underground; and (f) backfilling the cavity formed in the ground by the withdrawal of the drive tube with a selected material.

6. The method of claim 5, further comprising the step of introducing a desired quantity of carbonaceous material into the drive tube, such that the carbonaceous material substantially surrounds the anode.

7. The method of claim 6, wherein the carbonaceous material is coke.

8. A method for underground installation of an anode for a cathodic protection system, comprising the steps of:

(a) removably connecting an anode support tube to the upper end of a pilot auger;

(b) inserting and anode into the support tube;

(c) removably engaging a drive tube with the pilot auger such that:

(i) the drive tube and the pilot auger will rotate co-axially when rotation is imparted to the drive tube in a first direction; and (ii) the drive tube will become disengaged from the pilot auger when rotation is imparted to the drive tube in a second and opposite direction;

(d) connecting the support tube to the drive tube such that the support tube will rotate when the drive tube is rotated;

(e) positioning the lower end of the pilot auger over the ground surface at a desired location;

(f) rotating the drive tube in said first direction, causing the pilot auger and drive tube to penetrate to a desired depth below ground surface;

(g) rotating the drive tube in said second direction, causing the drive tube and the support tube to become disengaged from the pilot auger and to be withdrawn completely from the ground, leaving the pilot auger and anode in place underground; and (h) backfilling the cavity formed in the ground by the withdrawal of the drive tube with a selected material.

9. The method of claim 8, further comprising the step of introducing a desired quantity of carbonaceous material into the drive tube, such that the carbonaceous material substantially surrounds the anode.

10. The method of claim 9, wherein the carbonaceous material is coke.

* * * * *